US006932393B2

(12) United States Patent
Erices

(10) Patent No.: US 6,932,393 B2
(45) Date of Patent: Aug. 23, 2005

(54) MOTOR VEHICLE DOORLOCK WITH COMBINED CENTRAL LOCKING AND OPENING ACTUATOR

(75) Inventor: Bernardo Erices, Bergischgladbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/129,455

(22) PCT Filed: Sep. 5, 2001

(86) PCT No.: PCT/DE01/03397

§ 371 (c)(1),
(2), (4) Date: Nov. 1, 2002

(87) PCT Pub. No.: WO02/20925

PCT Pub. Date: Mar. 14, 2002

(65) Prior Publication Data

US 2003/0116977 A1 Jun. 26, 2003

(30) Foreign Application Priority Data

Sep. 7, 2000 (DE) ..... 100 44 350
May 29, 2001 (DE) ..... 101 26 290
Aug. 21, 2001 (DE) ..... 101 39 975

(51) Int. Cl.[7] ..... E05C 3/06
(52) U.S. Cl. ..... 292/216; 292/DIG. 23
(58) Field of Search ..... 292/216, 201, 292/DIG. 23

(56) References Cited

U.S. PATENT DOCUMENTS 5,802,894 A * 9/1998 Jahrsetz et al. ..... 70/264
6,050,620 A * 4/2000 Rogers et al. ..... 292/216
6,079,237 A * 6/2000 Hochart ..... 70/278.6
6,102,454 A * 8/2000 Weyerstall ..... 292/201
6,367,296 B1 * 4/2002 Dupont ..... 70/257
6,386,599 B1 * 5/2002 Chevalier ..... 292/201
6,607,222 B2 * 8/2003 Inoue ..... 292/216
6,648,379 B1 * 11/2003 Kordowski et al. ..... 292/201

FOREIGN PATENT DOCUMENTS

| | | |
|---|---|---|
| DE | 44 44 581 A1 | 6/1995 |
| DE | 195 21 024 A1 | 12/1996 |
| DE | 197 52 974 A1 | 9/1998 |
| EP | 0 710 755 A | 5/1996 |
| FR | 2 778 940 A | 11/1999 |

* cited by examiner

*Primary Examiner*—Gary Estremsky
(74) *Attorney, Agent, or Firm*—Nixon Peabody LLP; David S. Safran

(57) ABSTRACT

The subject matter of the invention is a motor vehicle door lock which can be locked and unlocked by motor and can be opened both mechanically and also by motor, with a lock mechanism with several interacting elements, and the outside actuating element (3) which can be actuated by hand from the outside door handle can actuate a release element or directly a lock element (8), especially a detent pawl, via a coupling element (5) in the coupled position and in the decoupled position executes an idle stroke, and the coupling element (5) can be moved by motor from the coupled position into the decoupled position and vice versa when the outside actuation element (3) is not actuated, for motorized actuation of the coupling element (5) there being a central interlock drive (12) and the central interlock drive (12) in a second function can also actuate the release element or the lock element (8). This is characterized in that normally opening actuation takes place mechanically only with the outside actuation element (3) and that the central interlock drive (12) in the second function actuates the release element or the lock element (8) only when the outside actuating element (3) is already in the idle stroke in this phase.

16 Claims, 8 Drawing Sheets

MOTOR VEHICLE DOORLOCK WITH COMBINED CENTRAL LOCKING AND OPENING ACTUATOR

BACKGROUND OF THE INVENTION

1. Field of the Invention

This invention relates to a motor vehicle door lock with a combined central interlock and opening drive which can be locked and unlocked by a motor and can be opened both mechanically and also by motor, with a lock mechanism with several interacting elements, and an outside actuating element which can be actuated by hand from the outside door handle can actuate a release element or directly a lock element, especially a detent pawl, via a coupling element in the coupled position, and in the decoupled position, executes an idle stroke, and in which the coupling element can be moved by motor from the coupled position into the decoupled position and vice versa when the outside actuation element is not actuated. Furthermore, for motorized actuation of the coupling element, there is a central interlock drive which can also actuate the release element or the lock element in a second function.

The concept of a motor vehicle door lock should be understood comprehensively, not only as relating to side door locks and rear door locks, but also, for example, to rear gate locks.

2. Description of Related Art

The known motor vehicle door lock underlying the present invention (published European Patent Application EP 0 710 755 B1), first of all, has the conventional lock elements in the form of a lock latch and a detent pawl which blocks the lock latch in the closed position, as well as a lock mechanism with several interacting elements which optionally actuate the lock elements. The elements of the lock mechanism include an outside actuation element which can be actuated by hand from the outside door handle or the like, in the form of a toggle lever which can actuate the detent pawl via a coupling element in the form of a swivelling level which can be moved in the lengthwise direction in the coupled position. In the decoupled position of the coupling element, specifically the position which has been pivoted by a drive projection into an undercut, the outside actuation element executes an idle stroke.

The coupling element is moved by an adjustment element out of the coupled into the decoupled position, by motorized actuation of the adjustment element by means of a central interlock drive. Upon repeated actuation of the central interlock drive in the same actuation direction, the adjustment element returns via spring force to its initial position in the manner of a ballpoint pen mechanism, and thus, the coupling element returns from the decoupled position into the coupled position.

In a second function, the central interlock drive has the function of an opening drive, specifically actuates the detent pawl. There can be an additional release element between the detent pawl and the central interlock drive for this purpose. The central interlock drive has a drive element which can be driven in two directions in the form of a driving pinion which engages a toothed segment on the adjustment element. In one direction, the drive element actuates the adjustment element, both coupling and decoupling, in the other direction the release element or the locking element.

The spring-loaded ballpoint pen mechanism of the known motor vehicle door lock can also be made with correct matching of the paths and spring forces such that the coupling element which is in the decoupled position, when the outside actuation element is actuated, can be moved by motorized actuation of the adjustment element into a storage position preceding the coupled position, from which storage position the coupling element is moved automatically into the coupled position when the actuation of the outside actuation element is omitted, and, as explained, under the action of the spring force of a spring element. This ensures that this motor vehicle door lock can also be unlocked by motor when, at the same time, opening actuation has taken place from the outside, the outside actuation element having therefore been actuated. The coupled position, therefore the unlocked position, is stored here under spring force, and after release of the outside actuating element, is automatically assumed under spring force. This is called a "luxury function".

The known motor vehicle door lock explained above is basically made as an electric lock; in normal operation, it can only be opened by motor. Only in emergency operation can it be mechanically opened by manual actuation of the outside actuating element.

When the electric lock is equipped with a "passive entry" function, also called an "electronic key", the motor vehicle door lock can be unlocked automatically when approaching the motor vehicle without pressing a button on the remote control module or the like.

A motor vehicle door lock system with a passive entry function requires a certain reaction phase for the control electronics. The length of the reaction phase is perceived as long as compared to conventional motor vehicle door lock systems. Pulling the outside door handle can take place under certain circumstances when the reaction of the control electronics has not yet been completed. Then, the operator is annoyed that he must pull the door handle a second time, because it is interpreted as a "malfunction". There are various approaches to somehow concealing or shortening the resulting total time of the reaction (published German Patent Applications DE 195 21 024 A1 and DE 197 52 974 A1).

A similar problem also occurs when a passive entry function is not set up, for example, when the passenger tries to open the passenger door from the outside, although the central interlock drive there has not moved the coupling element into the coupled position yet (unlocked position).

It is not always desirable to use a purely electric lock as a motor vehicle door lock. In fact, there is considerable mistrust of purely electric locks which no longer have any mechanical opening actuation. This mistrust is based on considerations of safety engineering.

For this purpose, it could be imagined that the initially explained known motor vehicle door lock (published European Patent Application EP 0 710 755 B1) underlying this invention can only be actuated mechanically by the outside door handle. Then, the central interlock drive need only perform the function of actuating the adjustment element. This motor vehicle door lock, however, would possibly be so slow in the reaction phase that the outside door handle would have to be pulled a second time in order to finally mechanically open the motor vehicle door lock.

SUMMARY OF THE INVENTION

Therefore, the object of the invention is to configure the known, initially explained motor vehicle door lock such that, in principle, it operates mechanically, but nevertheless in any case rapid opening takes place.

The aforementioned object is achieved in a motor vehicle door lock as initially described by having the normally opening actuation take place mechanically only with the outside actuation element and by having the central interlock drive, in the second function, actuate the release element or the lock element only when the outside actuating element is already in the idle stroke in this phase.

Therefore, in accordance with the invention, opening actuation is normally executed mechanically from the outside door handle. Therefore, in this respect, it is a purely mechanical motor vehicle door lock. The central interlock drive however has preserved its second function of an opening drive nevertheless, specifically when the outside door handle has been pressed or pulled more quickly than the control electronics for triggering the central interlock drive and the central interlock drive itself could react; this can occur especially when the passive entry function is implemented, regardless of the opening actuation of the outside door handle to implement electrical opening. Then, if the central interlock drive has not been able to execute unlocking, the central interlock drive takes effect in the second function and actuates the release element or the lock element as a motorized opening drive. Electrical opening of the motor vehicle door lock therefore takes place only when the operator actuates the outside door handle more quickly than the motorized, especially electric motor unlocking mechanism could react. A second actuation of the outside door handle is not necessary, because the door opens by itself.

Using the motorized central interlock drive which is present anyway, ease of operation is therefore improved; this will also be generally advantageous to a limited degree especially when a passive entry system is implemented in the motor vehicle. Nevertheless, it is possible to retain the motor vehicle door lock itself in the normal case (and especially in an emergency) as a motor vehicle door lock which can be opened purely mechanically. Therefore considerations of safety engineering no longer apply.

It is not important for the teaching of this invention whether the motor vehicle door lock is implemented in one part, therefore with lock elements and a lock mechanism which are executed in one unit, and optionally lock electronics, or in two parts with, on the one hand, the lock elements in a lock unit, and on the other hand, the lock mechanism and optionally the lock electronics in the control unit which is spatially separate from it. The latter is known in and of itself from the prior art (published German Patent Application DE 44 44 581 A1) with the advantage that the more moisture-sensitive control unit is located in the dry space of a motor vehicle door and only the less moisture-sensitive lock unit with the mechanical lock elements is located in the moist space of the motor vehicle door. Typical connecting elements for transmission of force are Bowden cables.

The invention is explained in detail below using drawings which show only two of the various possible embodiments.

DETAILED DESCRIPTION OF THE INVENTION

Figure 1:
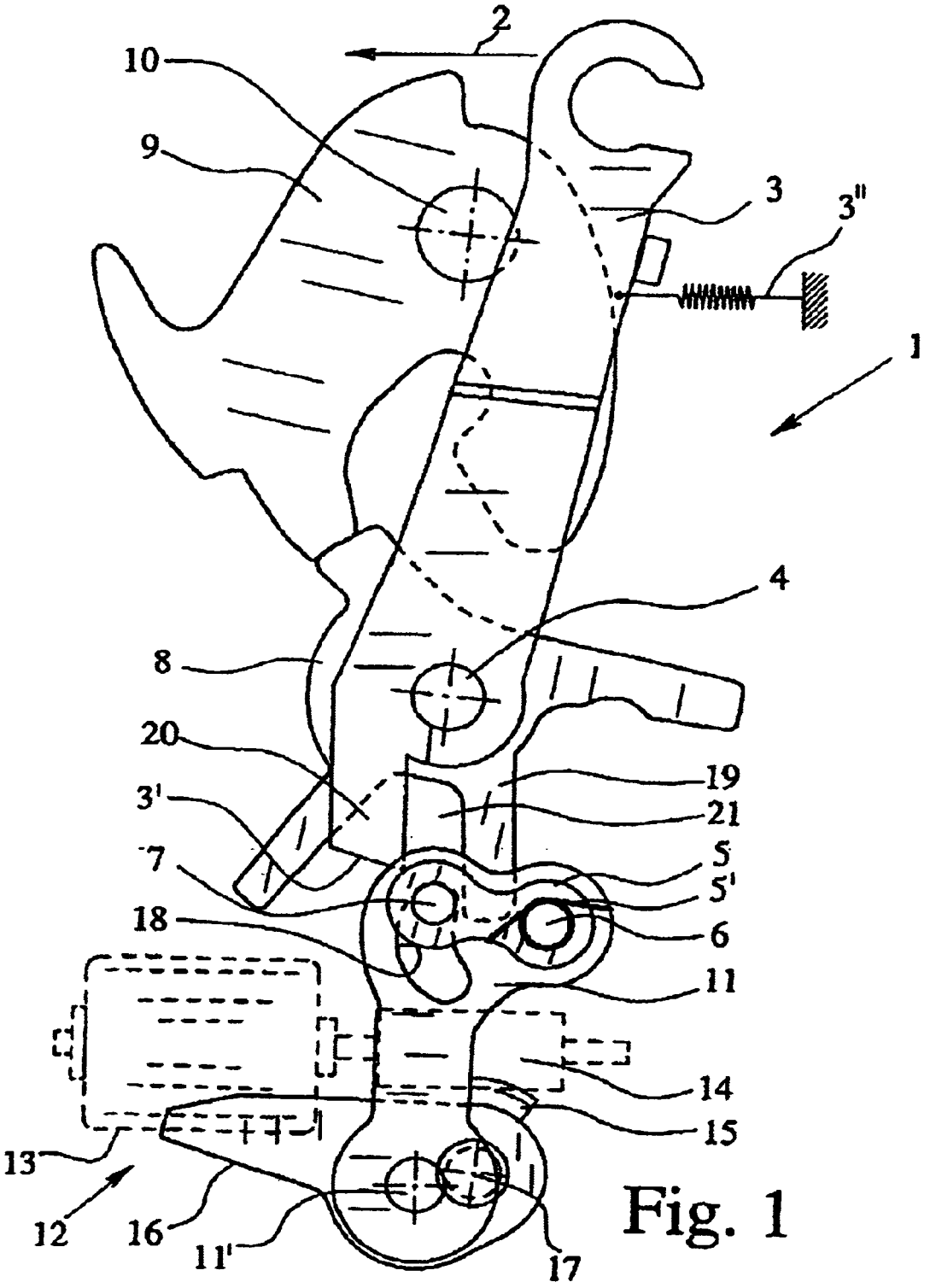
FIG. 1 is a side view a first embodiment of a motor vehicle door lock in the locked position and FIG. 1A is a side view of a second embodiment of a motor vehicle door lock in the locked position.

The motor vehicle door lock 1, which is shown schematically in FIG. 1 in a perspective view, is shown on the example of a motor vehicle side door lock. Also rear door locks, sliding door locks, hatch locks, etc., are intended to be encompassed by the term door lock as used herein.

One such motor vehicle door lock 1 belongs to a motor vehicle door lock system in which the different motor vehicle locks for motor vehicle doors and motor vehicle hatches can be locked and unlocked by motor, preferably an electric motor. The control electronics of such a motor vehicle door lock system can have the passive entry function which was explained in the general part of the specification. The illustrated motor vehicle door lock 1 is matched especially to boundary conditions when a passive entry function is implemented. As has already been stated in the general part of the specification, the teaching is also important in a normal remote-controlled motor vehicle door lock 1 with a motorized central interlock drive.

FIG. 1 shows, first of all, the motor vehicle door lock 1 with a lock mechanism with several elements which interact with one another. First of all, an outside actuating element 3 in the form of an outside actuation lever which is pivotally supported on a bearing axis 4 is shown; it can be actuated by hand from the outside door handle, the direction in which the force acts being indicated by the arrow 2. The outside actuating element 3 is loaded against the direction 2 in which the force acts by a pre-tensioning spring 3" shown in FIG. 1. The outside actuating element 3 is thus reset into it initial position shown in FIG. 1 under spring force when the outside door handle is released. There is, furthermore, a coupling element 5. The coupling element 5, in this embodiment, is made by dumbbell-shaped with a pivot axis 6 and a coupling journal 7. This is explained in detail below.

Furthermore, a locking element 8 is shown in the form of a detent pawl. The lock latch 9 which is held in the lock position by the detent pawl—lock element 8, can be seen in the closed position in FIG. 1. As is conventional, it can be made as a rotary latch with a bearing axle 10 without this being understood as limiting.

Figure 1A:
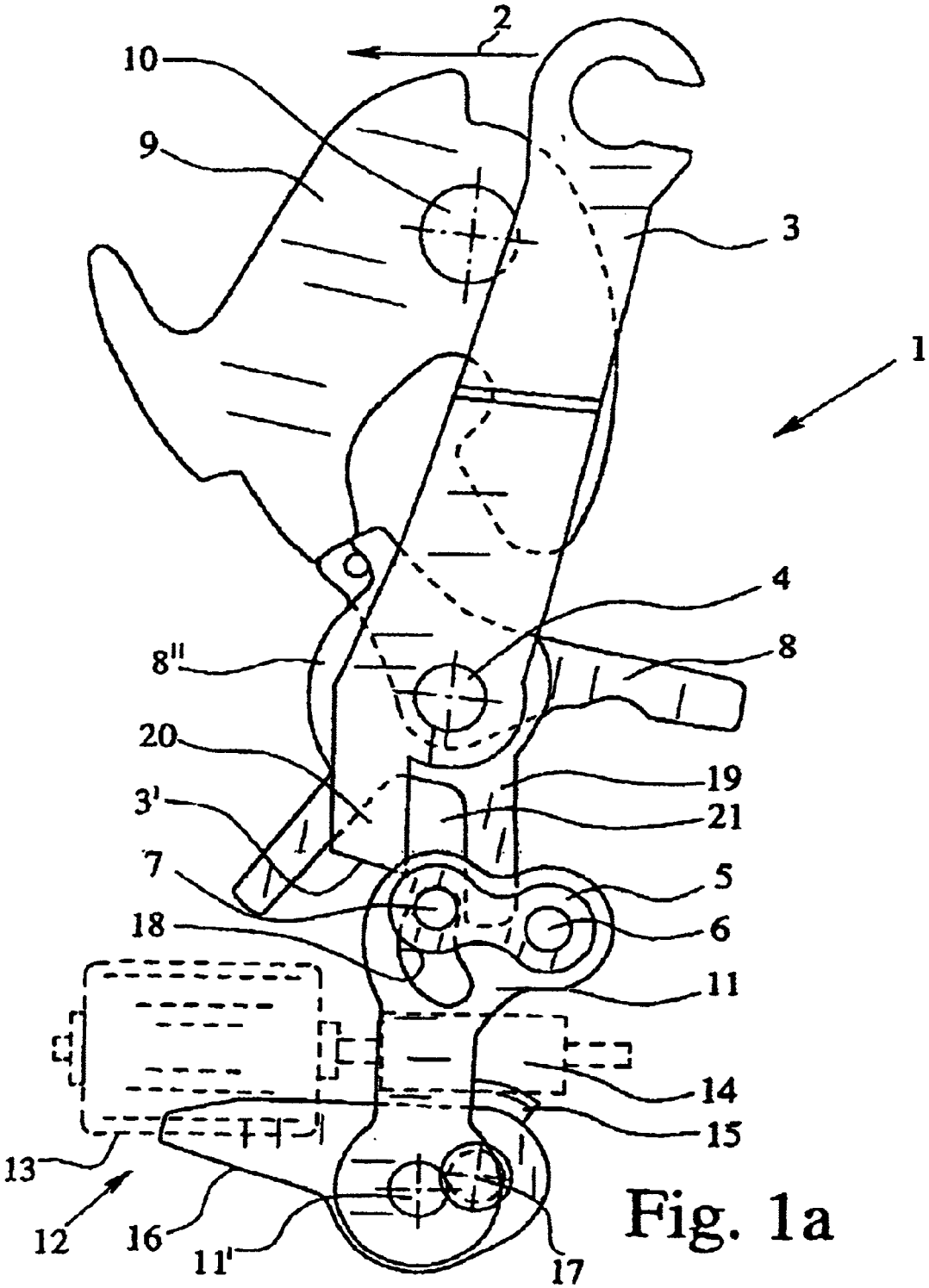

It is also possible, and it is also often implemented, to have an additional element, a release element 8", for example, in the form of trailing lever, between the lock element 8 and the coupling element 5, as illustrated in FIG. 1A. Release element 8" consists of a substantially radial appendix of lock element 8. In the course of movement, release element 8" cooperates with a pin of lock element 8. The lock element 8 is moved counterclockwise to enable the lock latch 9 to move into a release position.

In the coupled position, the outside actuating element 3 via the coupling element 5 actuates the lock element 8, in the decoupled position of the coupling element 5, the outside actuating element 3 executes an idle stroke when the outside door handle is pulled. FIG. 1 shows the decoupled position.

When the outside actuating element 3 has not been actuated, the coupling element 5 can be moved out of the coupled position into the decoupled position and vice versa by an adjustment element 11 which can be actuated by motor. The central interlock drive 12 is used for motorized actuation of the adjustment element 11. The interlock drive, in this embodiment, has, as shown in FIG. 1, an electric drive motor 13 and a worm gear pair 14. Other embodiments are known from the prior art and can be used.

In the second function, the central interlock drive 12 can actuate the lock element 8. How this happens is explained in further detail below.

What is important, first, is that opening actuation normally takes place mechanically only with the outside actuating element 3. The central interlock drive 12 actuates the lock element 8 in the second function only when the outside actuating element 3, in this phase, is already in the idle stroke, therefore has been mechanically actuated so quickly that the coupling element 5 has not yet reached the coupled position. In this way, it is concealed to the operator that the directly following opening of the motor vehicle door lock 1 has not taken place by mechanical actuation with pulling of the outside door handle, but electrically in the second function by the central interlock drive 12. But, this function only occurs in exceptional cases. Normally, when there is enough time for actuating the adjustment element 11 by the central interlock drive 12 in the first function, the subsequent opening actuation of the motor vehicle door lock 1 takes place purely mechanically in the classical manner.

With the above explained design, on the one hand, the safety considerations of many automobile manufacturers are taken into account by making available a motor vehicle door lock 1 which can fundamentally be actuated mechanically and which can also be opened mechanically in an accident, and on the other hand, by skillful double use of the central interlock drive 12, the actuation problem which can occur especially when implementing the passive entry function or pulling on the outside door handle which leads in some way is considered.

It could be provided that the central interlock drive 12 has a drive element 15 which can be driven in two directions, especially in the form of a drive pinion or a drive cam which, in one direction, actuates the adjustment element 11, and in the other opposite direction, actuates the release element or the lock element 8. This would be the design which is implemented in the central interlock drive of the prior art underlying the teaching of this application (published European Patent Application EP 0 710 755 B1).

The preferred embodiment which is shown takes a different approach, specifically one in which the central interlock drive 12 has a drive element 15 which can be driven in two directions, especially in the form of a drive pinion or a drive cam which, in one direction, actuates the adjustment element 11 in the direction of the coupled position and the release element or the lock element 8 and in the other, opposite direction actuates the adjustment element 11 in the direction of the decoupled position and releases the lock element 8. Thus, there is directionally-identical actuation of the adjustment element 11 in the direction of the coupled position and of the lock element 8 in the opening direction (lifting of the detent pawl).

The illustrated embodiment shows the drive element 15 made fundamentally as a drive pinion, but degenerated into a toothed arc because here pivoting over only a relatively small angular range in two directions is necessary.

Figure 2:
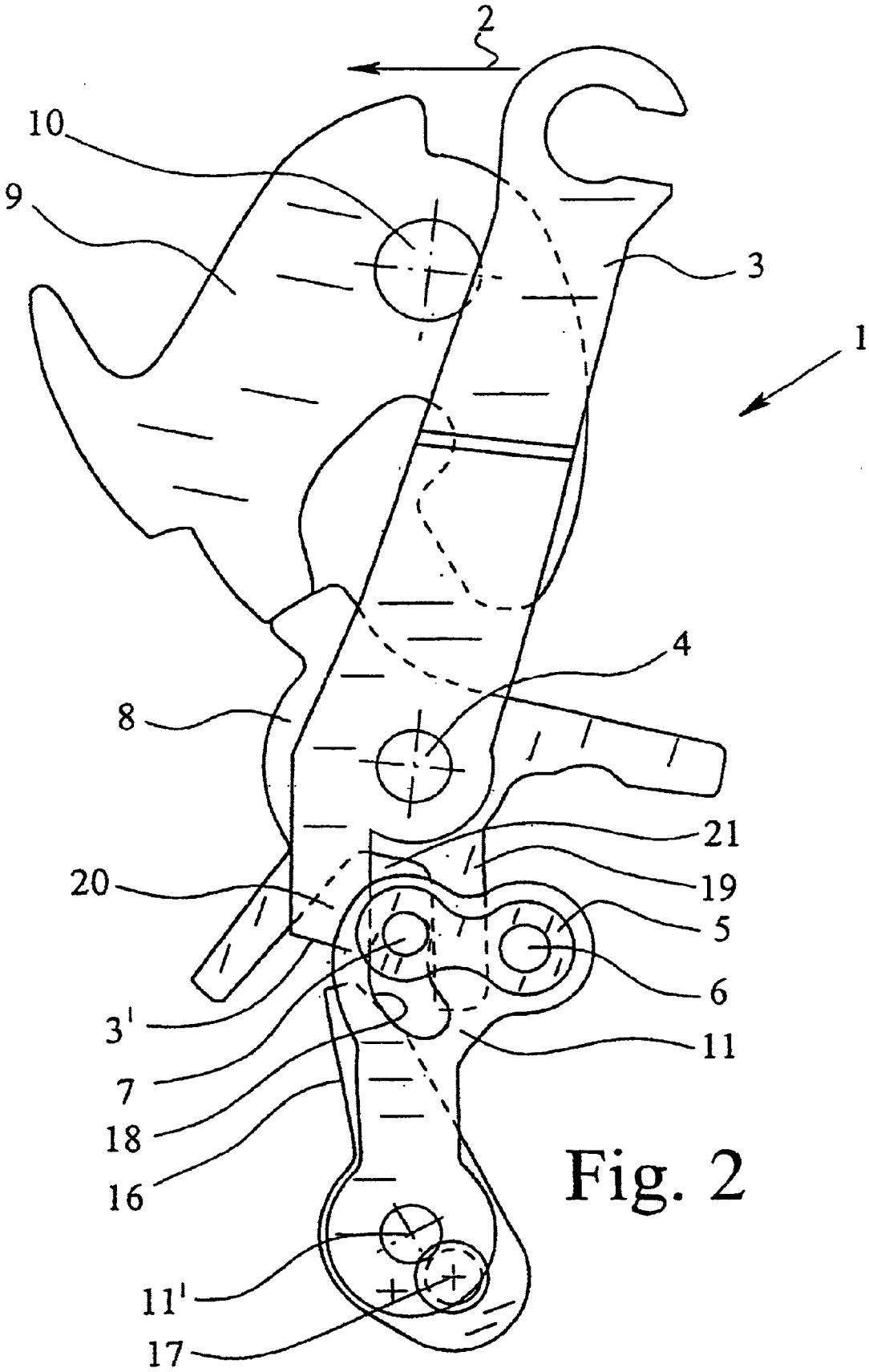
FIG. 2 shows the motor vehicle door lock from FIG. 1, but now in the unblocked position, the outside door handle having not been pulled.
Figure 3:
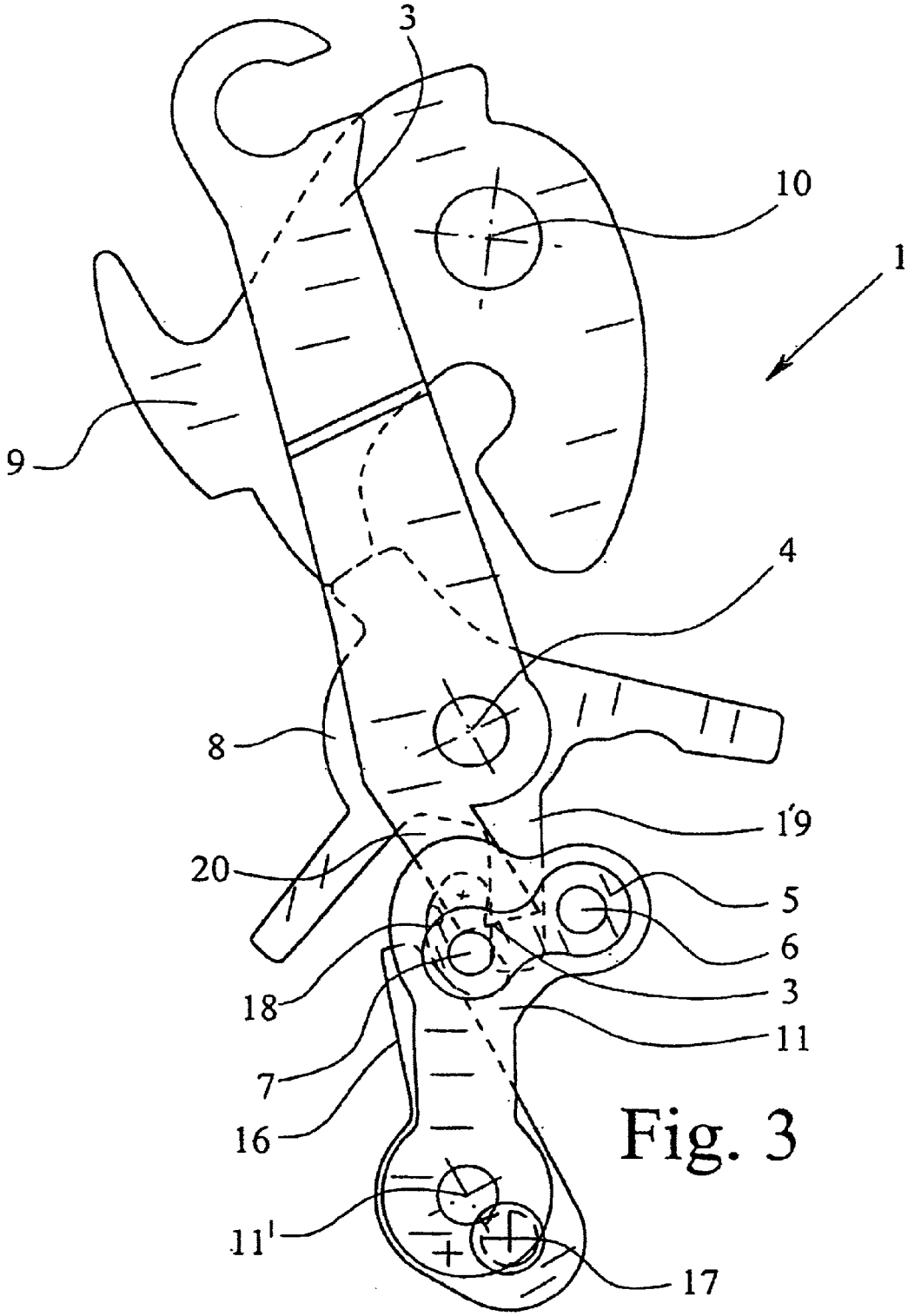
FIG. 3 is a view corresponding to that of FIG. 2 after the outside door handle has been pulled and in an idle stroke before the unlocked position is reached.

The illustrated embodiment shows, as is apparent from comparison of FIGS. 2 and 3, that here the initially mentioned "luxury function" is implemented. This is implemented by the coupling element 5, which is in the decoupled position when the outside actuating element 3 is actuated, being able to be moved by motorized actuation of the adjustment element 11 into the storage position which precedes the coupled position (shown in FIG. 3) from which storage position, when actuation of the outside actuating element 3 is omitted, the coupling element 5 is automatically moved into the coupled position (shown in FIG. 2). The latter takes place preferably under the force of a predetermined spring 5', shown in FIG. 1, which acts clockwise in this embodiment on the coupling element 5.

The storage position which precedes the coupled position is defined in this embodiment by a catch 3' on the outside actuating element 3 which, when the outside actuating element 3 is in the idle stroke, prevents the coupling element 5 from engaging the coupled position. To do this, in this embodiment the coupling journal 7 under the spring force of a pre-tensioning spring, which acts clockwise and which is not shown, adjoins the catch 3'. If the outside actuating element 3 has returned to its initial position, the path for the coupling journal 7 into the coupled position is free.

After releasing the outside actuating element 3, the mechanical coupling to the lock element 8 is closed, regardless of the fact that lifting of the lock element 8 by means of the central interlock drive 12 has already taken place in the meantime in its second function as the opening drive. The following opening actuations again take place purely mechanically.

In the above explained embodiment, an especially feasible design which is shown in the drawings is characterized in that the drive element 15 is connected to a pivot arm 16 which, when the drive element 15 is actuated, pivots in one direction around the pivot axis 17 such that its free end meets the release element or the lock element 8 and actuates it if the coupling element 5 is not in the coupled position, and runs freely if the coupling element 5 is in the coupled position. The free-running position is shown in FIG. 2. Here, the coupling journal 7 on the coupling element 5 is not between the pivot arm 16 and lock element 8. The pivot arm 16 can pivot relatively far clockwise without influencing the detent pawl-lock element 8.

Conversely, in FIG. 3, the coupling journal 7 is between the pivot arm 16 and the lock element 8. Further pivoting of the pivot arm 16, clockwise in FIG. 3, would lead to the fact that the lock element 8 would be pivoted around the bearing axis 4 counterclockwise because the coupling journal 7, to a certain extent, "pushes it in front of itself."

The illustrated embodiment shows an especially feasible, toggle level-like design of the mechanism on the central interlock drive 12. It is provided that the adjustment element 11 is made as a lever (pivot axis 11') which is supported on the pivot arm 16 at a distance from the pivot axis 17, and which, when the pivot arm 16 pivots around the pivot axis 17, executes an essentially linear adjustment motion. The drive motion of the drive element 15 is therefore converted, on the one hand, into a pivoting motion of the pivot arm 16, and on the other hand, leads to displacement of the adjustment element 11 for purposes of moving coupling element 5. Thus, the desired superimposed motions for different functions can be implemented, although the central interlock drive 12 runs only in one direction (and returns counter to this direction back to the starting point).

The coupling element 5, in this embodiment, is made as a lever which runs on one end in a slot 18 with the coupling journal 7 and which is pivotally mounted on the adjustment element 11. The slot 18 is made in the shape of a circular arc (kidney bean-shaped) in the adjustment element 11, on the right next to this slot 18 is the pivot axis 6 of the coupling element 5.

It furthermore applies to the preferred embodiment shown that the lever which forms the coupling element 5 is spring-loaded towards the end of the slot 18 facing the coupled position by a pre-tensioning spring 5'.

FIGS. 1 to 3, furthermore, show that, in this preferred embodiment, the actuation arm 19 of the lock element 8 and the actuation arm 20 of the outside actuating element 3 form a slot 21 which is open on one end and into which the coupling journal 7 of the coupling element 5 in the coupled position dips and in the decoupled position does not dip. The coupled position is shown by FIG. 2, the decoupled position is shown in FIG. 1.

The second function for the central interlock drive 12 is implemented by the actuating arm 19 of the closing element 8 extending beyond the open end of the slot 21 and the journal 7 of the coupling element 5 also being in the decoupled position, and optionally, in the storage position in front of this actuating arm 19. Therefore, force can also be transferred here to the lock element 8—detent pawl, but only from the pivot arm 16 of the central interlock drive 12. Conversely, the coupling journal 7 with normal actuation by hand fits upward into the slot 21, the pivot arm 16 is now deactivated, and for this reason, the outside actuating element 3 acts via the actuating arm 20.

In general, the part which dips into the slot 21 need not be a journal 7. This part 7 of the coupling element 5 can also have other forms, for example, it can be molded in one piece on the coupling element 5.

FIG. 1 shows the central interlock drive 12 underneath the lock element 8 and the rotary latch 9. For this reason, this arrangement stands relatively high. Conversely, it is possible for the outside actuating element 3 to be supported on the bearing axis 4 on which the lock element 8 is supported.

Figure 4:
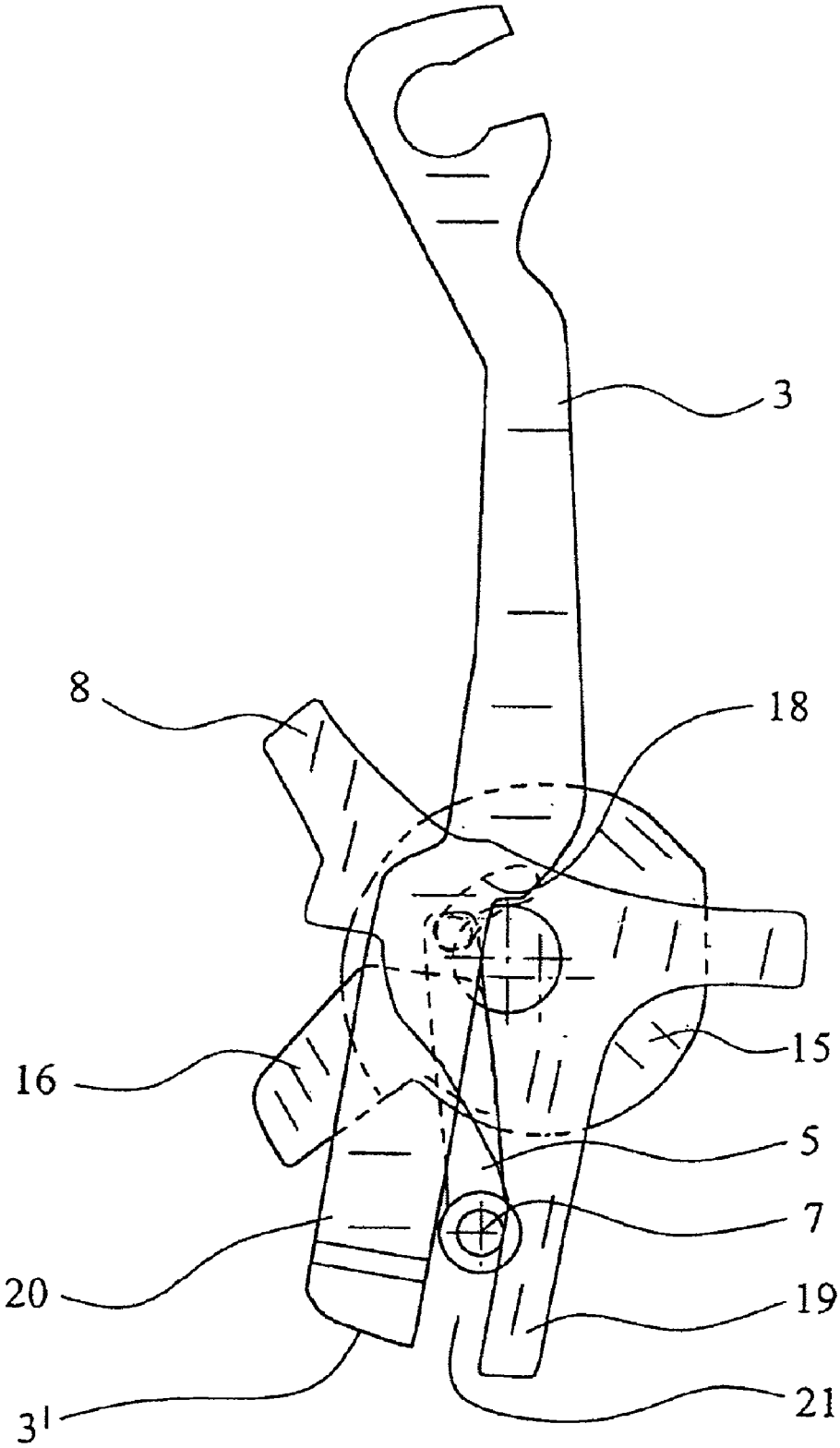
FIG. 4 is a view corresponding to that of FIG. 1, but of a second embodiment of a motor vehicle door lock in accordance with the invention.

FIG. 4 shows an embodiment which differs from the previously explained embodiment, first of all, in that the central interlock drive has been moved up, roughly to the level of the lock element 8. The makes the overall structure of the motor vehicle door lock 1 more compact in height (relative to the plane of the drawing) in any case.

Furthermore, the lock mechanism has been simplified by the omission of the adjustment element 11 which is present in the first embodiment of the lock mechanism. This is because, here, the coupling element 5 is supported directly on the drive element 15. The coupling element 5, itself, can execute limited relative motion as compared to the drive element 15 by being made as a lever which runs on the drive element 15 in a slot 18 and being spring-loaded towards the end of the slot 18 facing the coupled position in the drive element 15.

FIG. 4 shows this embodiment in the position corresponding to FIG. 1, i.e., the locking position, the coupling element 5 therefore being in the decoupled position. The catch 3 on the outside actuation element 3 in this position, in an idle stroke, will swing past the coupling journal 7 of the coupling element 5, and this coupling journal 7 will stop in front of the actuating arm 19 of the lock element 8. The indicated pivot arm 16, on the other hand, will meet the journal 7 in this position, even when the coupling element 5 remains in position (deflected against spring force) and moves the actuating arm 19 via the journal.

Figure 5:
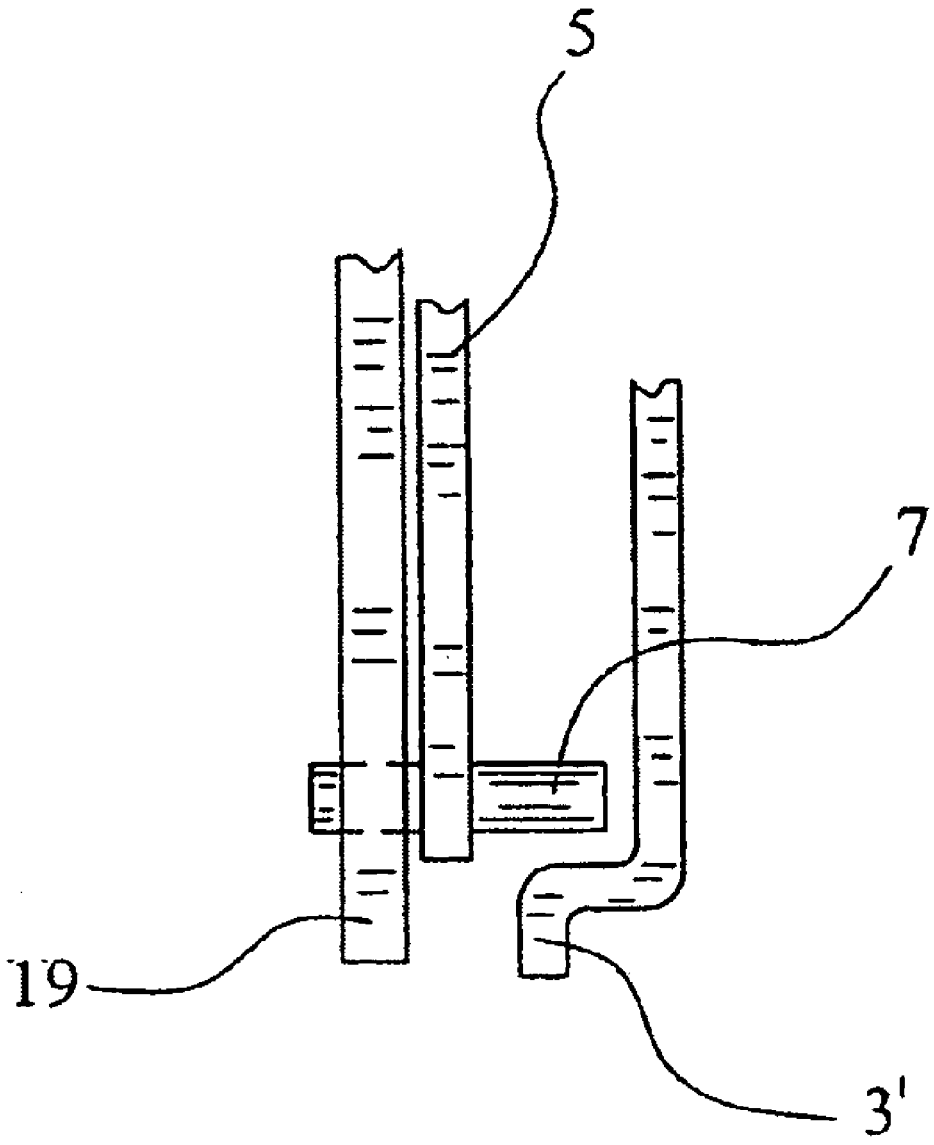
FIG. 5 shows a portion of the embodiment from FIG. 4 in the lower area of the outside actuating element.

FIG. 5 shows the lower area of the outside actuation element 3 with the catch 3'. It is apparent that the outside actuation element 3 is "elbowed" to form the catch 3' and projects with the catch 3' into the path of motion of the coupling journal 7. In the position shown in FIG. 4, as FIG. 5 shows, the catch 3' is offset to the bottom relative to the coupling journal 7, so that the coupling journal 7 is not affected. However, if the coupling journal 7 is displaced down, it moves in front of the catch 3' and the latter can then transfer force to the actuating arm 19 of the lock element 8 via the interposed coupling journal 7.

The special advantages of the motor vehicle door lock 1 in accordance with the invention have already been explained in the general part of the specification; reference should be made there.

Figure 6:
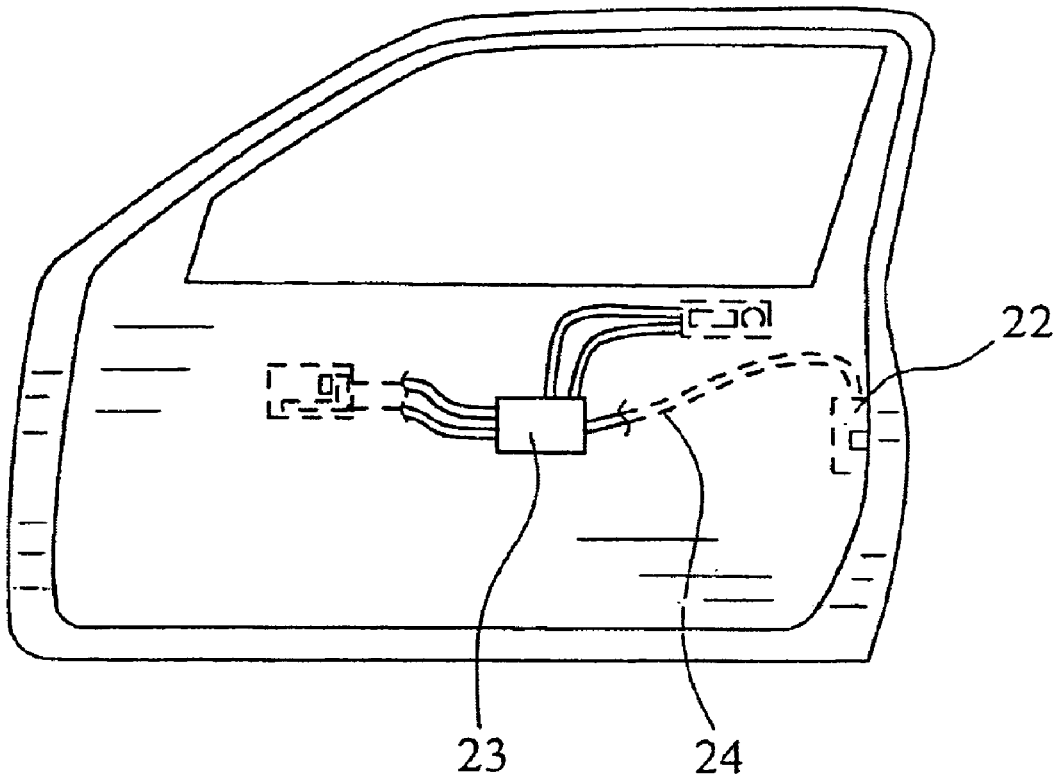
FIG. 6 is a schematic of a motor vehicle door lock made in two parts and FIG. 7 shows a control unit of the motor vehicle door lock made in two parts of FIG. 6.
Figure 7:
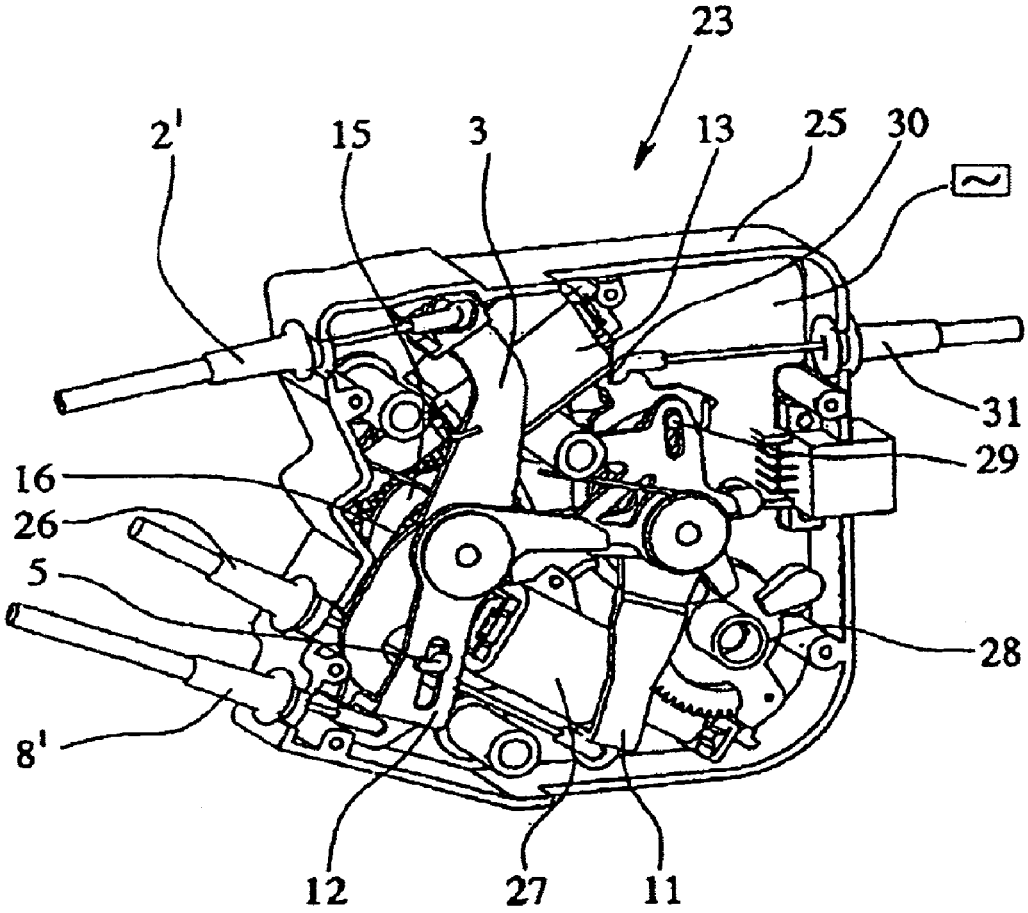

FIGS. 6 and 7 show an embodiment in which the motor vehicle door lock is made in two parts. This concept is already known from the prior art (published German Patent Application DE 44 44 581 A1) and makes it possible to house the moisture-sensitive components of the motor vehicle door lock in the dry space of the motor vehicle door and to leave only the less moisture-sensitive lock elements in the wet space. FIG. 6 shows the lock elements, specifically the detent pawl 8 and the lock latch 9, in a mechanical lock unit 22 which sits at the conventional location on the front sheet of the motor vehicle door and preferably is protected as well as possible against the entry of moisture from the inside and the outside. The other components of the motor vehicle door lock, especially therefore the lock mechanism and lock electronics which may be present, are combined in a control unit 23 which is spaced away from the lock unit 22. The control unit 23 is located in the dry space of the motor vehicle door on the inside of the partition between the wet space and the dry space. The lock unit 22 is connected by means of a mechanical distance-force transmission means 24 to the control unit 23. This force transmission means 24 can preferably include Bowden cables 2' and 8'. This is also the situation in the embodiment shown. The transfer of the mechanical force transmission means 24 from the dry space into the wet space can thus be done best with this. Of course, naturally there are also other force transmission means 24, for example, rods with or without deflection levers.

FIG. 7 shows a control unit 23 of the preferred embodiment of a motor vehicle door lock in accordance with the invention. The aforementioned individual elements of the lock mechanism in this control unit 23 are identified with the same reference numbers as in the above explained embodiment. It is indicated that the lock electronics are located in the plane behind the illustrated plane in the housing 25 of the control unit 23.

In addition to the above explained elements, the embodiment of FIG. 6 has another Bowden cable 26 to engage the locking cylinder on the adjustment element 11 (central interlock safety lever) and an anti-theft drive which has a second electric drive motor 27 and a separate worm wheel 28. The anti-theft drive moves an anti-theft journal 29 in an angle-shaped elongated hole of the inside actuating lever 30 which, for its part, is connected to the inside door handle by means of another Bowden cable 31. Reference should also be made to the prior art for this fundamental design.

It is therefore apparent, overall, that the implementation of the teaching of this invention results in a certain function of the motor vehicle door lock which is independent of whether the motor vehicle door lock is made in one part or two. Even when there are two parts, the force transmission conditions can be implemented by Bowden cables, etc.

The advantages of a two-part arrangement of the motor vehicle door lock are the following, among others.

In a suitable arrangement of the control unit 23, especially in the vicinity of the door hinges in the motor vehicle door or hatch, the control unit 23 with the impact-sensitive lock electronics located in it are exposed to less mass acceleration than as in the past on the edge of the motor vehicle door away from the coupling point.

The two-part execution makes it possible, on the one hand, to execute the lock unit 22, and on the other hand, the control unit 23, in the manner of a block, therefore is no longer in an L-shape as in the integrated execution. This makes it possible to better use the construction space in the motor vehicle door or hatch.

Combination with a corresponding inside handle arrangement allows emergency locking directly on the control unit 23 from the inside.

Finally, with a suitable arrangement of the control unit 23, there is improved anti-theft protection.

The passive entry system and a switch for detection of actuation of the outside door handle make it possible for the control electronics to recognize whether only unlocking is taking place or whether the motorized drive is also to perform the opening function. The electrical drive motor 13 of the central interlock drive 12 can be triggered in this way, if necessary, with only the power supply necessary at the time.

To protect the mechanism and to keep the noise as low as possible, for example the trigger voltage of the electric drive motor 13 in the central interlock function can be lower than in the opening function, for example, 8.0 V instead of 12.0 V.

What is claimed is:

1. Motor vehicle door lock which can be locked and unlocked by motor and can be opened both mechanically and also by motor, comprising:

a lock mechanism with several interacting elements, including:

a lock element in the form of a detent pawl, a lock latch which is held in a lock position by the lock element and which is released from the lock position when the lock element is actuated, and a coupling element, wherein said coupling element has:

a coupled position in which an outside actuating element, when actuated by hand from the outside door handle, actuates the lock element via the coupling element, and a decoupled position in which the outside actuating element, when actuated by hand from the outside door handle, executes an idle stroke; and a central interlock drive having a motor for moving the coupling element from the coupled position to the decoupled position and from the decoupled position to the coupled position when the outside actuation element is not actuated, wherein, if actuation of the outside actuating element begins with the coupling element in the coupled position, actuation of the lock element can be obtained mechanically by the operation of the outside actuating element, wherein, if the outside actuating element is already in the idle stroke and the coupling element has not yet reached the coupled position, the coupling element is prevented from reaching the coupled position, but actuation of the lock element can be obtained in that position in a motorized manner by the motor of the central interlock drive; and wherein the coupling element is actuable by the motor of the central interlock drive via an adjustment element;

wherein the coupling element is moveable by motorized actuation from the decoupled position, when the outside actuation element is actuated, into a storage position preceding the coupled position, the coupling element being automatically moveable from the storage position into the coupled position when the actuation if the outside actuation element is not actuated;

wherein the drive element is connected to a pivot arm which, when the drive element is actuated, pivots in a direction around a pivot axis such that a free end thereof meets said one of the release element and the lock element and actuates it if the coupling element is not in the coupled position, and runs freely if the coupling element is in the coupled position; and wherein the adjustment element is a lever which is supported on the pivot arm at a distance from the pivot axis and which, when the pivot arm pivots around the pivot axis, executes an essentially linear motion.

2. Motor vehicle door lock as claimed in claim 1, wherein the coupling element is supported directly on the drive element and is able to execute limited relative motion relative to the drive element.

3. Motor vehicle door lock as claimed in claim 2, wherein the coupling element is a lever which runs on the drive element in a slot.

4. Motor vehicle door lock as claimed in claim 3, wherein the lever is spring-loaded towards an end of the slot facing the coupled position.

5. Motor vehicle door lock which can be locked and unlocked by motor and can be opened both mechanically and also by motor, comprising:

a lock mechanism with several interacting elements, including;

a lock element in the form of a detent pawl, a lock latch which is held in a lock position by the lock element and which is released from the lock position when the lock element is actuated, and a coupling element, wherein said coupling element has:

a coupled position in which an outside actuating element, when actuated by hand from the outside door handle, actuates the lock element via the coupling element, and a decoupled position in which the outside actuating element, when actuated by hand from the outside door handle, executes an idle stroke; and a central interlock drive having a motor for moving the coupling element from the coupled position to the decoupled position and from the decoupled position to the coupled position when the outside actuation element is not actuated, wherein, if actuation of the outside actuating element begins with the coupling elements in the coupled position, actuation of the lock element can be obtained mechanically by the operation of the outside actuating element, wherein, if the outside actuating element is already in the idle stroke and the coupling element has not yet reached the coupled position, the coupling element is prevented from reaching the coupled position, but actuation of the lock element can be obtained in that position in a motorized manner by the motor of the central interlock drive; and wherein the coupling element is actuable by the motor of the central interlock drive via an adjustment element; and wherein the coupling element is actuable by the motor of the central interlock drive via an adjustment element; and wherein the coupling element is a lever, one end of which runs in a slot and an opposite end of which is pivotally mounted on the adjustment element.

6. Motor vehicle door lock as claimed in claim 5, wherein the lever is spring-loaded towards an end of the slot facing the coupled position.

7. Motor vehicle door lock which can be locked and unlocked by motor and can be opened both mechanically and also by motor, comprising:

a lock mechanism with several interacting elements, including:

a lock element in the form of a detent pawl, a lock latch which is held in a lock position by the lock element and which is released from the lock position when the lock element is actuated, and a coupling element, wherein said coupling element has:

a coupled position in which an outside actuating element, when actuated by hand from the outside door handle, actuates the lock element via the coupling element, and a decoupled position in which the outside actuating element, when actuated by hand from the outside door handle, executes an idle stroke; and a central interlock drive having a motor for moving the coupling element from the coupled position to the decoupled position and from the decoupled position to the coupled position when the outside actuation element is not actuated, wherein, if actuation of the outside actuating element begins with the coupling element in the coupled position, actuation of the lock element can be obtained mechanically by the operation of the outside actuating element, wherein, if the outside actuating element is already in the stroke and the coupling element has not yet reached the coupled position, the coupling element is prevented from reaching the coupled position, but actuation of the lock element can be obtained in that position in a motorized manner by the motor of the central interlock; and wherein the lock mechanism further comprises a catch which, when the outside actuating element is in the idle stroke, prevents the coupling element from engaging the coupled position.

8. Motor vehicle door lock as claimed in claim 7, wherein the motor of the central interlock drive is an electric drive motor.

9. Motor vehicle door lock as claimed 8, wherein the electric drive motor works with less power for performing said first function for locking and unlocking, than for performing second function for actuating said one of the release element and the lock element.

10. Motor vehicle door lock which can be locked and unlocked by motor and can be opened both mechanically and also by motor, comprising:

a lock mechanism with several interacting element, including:

a lock element in the form of a detent pawl, a lock latch which is held in a lock position by the lock element and which is released from the lock position when the lock element is actuated, and a coupling element, wherein said coupling element has:

a coupled position in which an outside actuating element, when actuated by hand from the outside door handle, actuates the lock element via the coupling element, and a decoupled position in which the outside actuating element, when actuated by hand from the outside door handle, executes an idle stroke; and a central interlock drive having a motor for moving the coupling element from the coupled position to the decoupled position and from the decoupled position to the coupled position when the outside actuation element is not actuated, wherein, if actuation of the outside actuating element begins with the coupling element in the coupled position, actuation of the lock element can be obtained mechanically by the operation of the outside actuating element, wherein, if the outside actuating element is already in the idle stroke and the coupling element has not yet reached the coupled position, the coupling element is prevented from reaching the coupled position, but actuation of the lock element can be obtained in that position in a motorized manner by the motor of the central interlock drive; and wherein the lock element and the outside actuating element each have an actuation arm; and wherein the actuation arm of the lock element and the actuation arm of the outside actuating element from a slot which is open on one end and into which a part of the coupling element dips in the coupled position and is removed in the decoupled position.

11. Motor vehicle door lock as claimed in claim 10, wherein a portion of the actuating arm of the lock element extends beyond open end of the slot and wherein part of the coupling element is located in front of said portion of the actuating arm in the decoupled position.

12. Motor vehicle door lock which can be locked and unlocked by motor and can be opened both mechanically and also by motor, comprising:

a lock mechanism with several interacting elements, including:

a lock element in the form of a detent pawl, a lock latch which is held in a lock position by the lock element and which is released from the lock position when the lock element is actuated, and a coupling element, wherein said coupling element has:

a coupled position in which an outside actuating element, when actuated by hand from outside door handle, actuates the lock element via the coupling element, and a decoupled position in which the outside actuating element, when actuated by hand from the outside door handle, executes an idle stroke; and a central interlock drive having a motor for moving the coupling element from the coupled position to the coupled position and from the decoupled position to the coupled position when the outside actuation element is not actuated, wherein, if actuation of the outside actuating element begins with the coupling element in the coupled position, actuation of the lock element can be obtained mechanically by the operation of the outside actuating elements, wherein, if the outside actuating element is already in the idle stroke and the coupling element has not yet reached the coupled position, the coupling element is prevented from reaching the coupled position, but actuation of the lock element can be obtained in that position in a motorized manner by the motor of the central interlock drive; and wherein said interacting elements of the lock mechanism are combined in a mechanical lock unit, wherein other components of the motor vehicle door lock are combined in control unit, wherein the lock unit is located spaced away from the control unit, and wherein the released element for actuating the lock element is a mechanical distance-force transmission means.

13. Motor vehicle door lock as claimed in claim 12, wherein said mechanical distance-force transmission means is a Bowden cable.

14. Motor vehicle door lock as claimed in claim 12, wherein the lock unit is placed in an area exposed to moisture and the control unit is placed in a dry space, and wherein the mechanical force transmission means penetrates a separation between the dry space an the area exposed to moisture.

15. Motor vehicle door lock as claimed in claim 12, wherein at least one of the lock unit and the control unit has a housing which encloses it toward the outside.

16. Motor vehicle door lock which can be locked and unblocked by motor and can be opened both mechanically and also by motor, comprising:

a lock mechanism with several interacting elements, including:

a lock element in the form of a detent pawl, a lock latch which is held in a lock position by the lock element and which is released from the lock position when the lock element is actuated, and a coupling element, wherein said coupling element has:

a coupling position in which an outside actuating element, when actuated by hand from the outside handle, actuates the lock element via the coupling element, and a decoupled position in which the outside actuating element, when actuated by hand from the outside door handle, executes an idle stroke; and a central interlock drive having a motor for moving the coupling element from the coupled position to the decoupled position and from the decoupled position to the coupled position when the outside actuation element is not actuated, wherein, if actuation of the outside actuating element begins with the coupling elements in the coupled position, actuation of the lock element can be obtained mechanically by the operation of the outside actuating element, wherein, if the outside actuating element is already in the idle stroke and the coupling element has not yet reached the coupled position, the coupling element is prevented from reaching the coupled position, but actuation of the lock element can be obtained in that position in a motorized manner by the motor of the central interlock drive;

wherein the motor of the central interlock drive is an electric drive motor;

wherein the electric drive motor works with less power for performing said first function for locking and unlocking, than for performing second function for actuating said one of the release element and the lock element; and wherein the electric drive motor in the first function is triggered with a lower voltage than in the second function.

* * * * *